United States Patent [19]

Grossman et al.

[11] Patent Number: 4,534,742

[45] Date of Patent: Aug. 13, 1985

[54] METHOD AND APPARATUS FOR DISPENSING SMALL QUANTITIES OF MERCURY FROM EVACUATED AND SEALED GLASS CAPSULES

[75] Inventors: Mark W. Grossman, Framingham; William A. George, Rockport; Robert Y. Pai, Hamilton, all of Mass.

[73] Assignee: GTE Products Corporation, Stamford, Conn.

[21] Appl. No.: 568,023

[22] Filed: Jan. 4, 1984

[51] Int. Cl.[3] ..... H01J 9/395

[52] U.S. Cl. ..... 445/9; 445/60

[58] Field of Search ..... 445/9, 16, 60

[56] References Cited

U.S. PATENT DOCUMENTS

| | | | |
|---|---|---|---|
| 3,684,345 | 8/1972 | Schiekel | 445/9 |
| 3,913,999 | 10/1975 | Clarke | 445/9 |
| 4,427,919 | 1/1984 | Grenfell | 445/9 X |

FOREIGN PATENT DOCUMENTS

| | | | |
|---|---|---|---|
| 4750 | 10/1979 | European Pat. Off. | 445/9 |
| 50549 | 4/1980 | Japan | 445/9 |

*Primary Examiner*—Kenneth J. Ramsey

*Attorney, Agent, or Firm*—William H. McNeill

[57] ABSTRACT

A technique for opening an evacuated and sealed glass capsule containing a material that is to be dispensed which has a relatively high vapor pressure such as mercury. The capsule is typically disposed in a discharge tube envelope. The technique involves the use of a first light source imaged along the capsule and a second light source imaged across the capsule substantially transversely to the imaging of the first light source. Means are provided for constraining a segment of the capsule along its length with the constraining means being positioned to correspond with the imaging of the second light source. These light sources are preferably incandescent projection lamps. The constraining means is preferably a multiple looped wire support.

14 Claims, 6 Drawing Figures

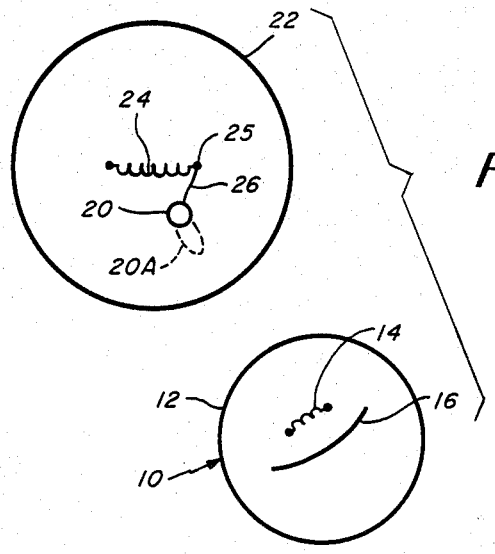
Fig. 2
Fig. 3
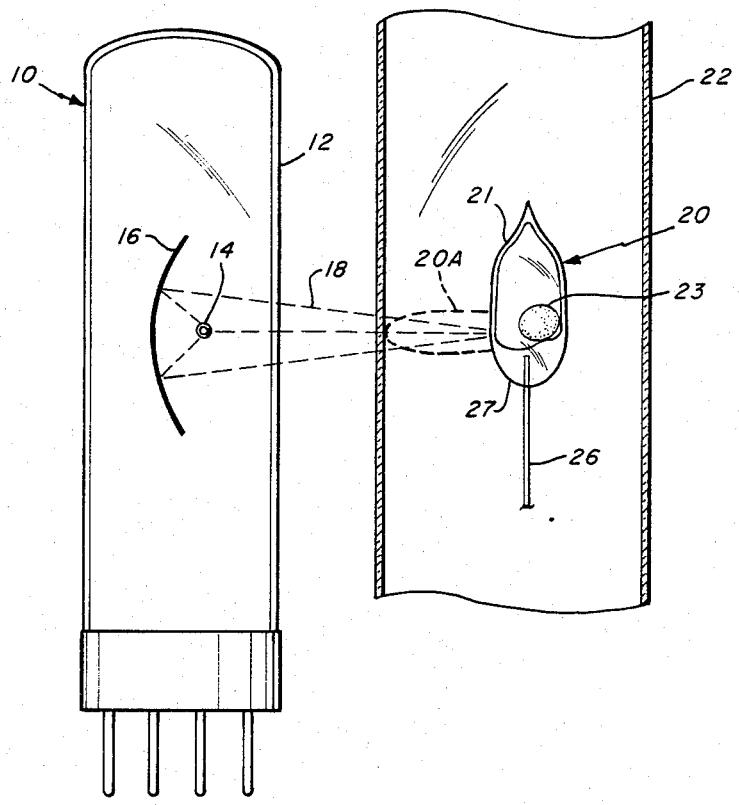

METHOD AND APPARATUS FOR DISPENSING SMALL QUANTITIES OF MERCURY FROM EVACUATED AND SEALED GLASS CAPSULES

The Government has rights in this invention pursuant to Contract No. DE-AC03-76SF0098 awarded by the U.S. Department of Energy.

TECHNICAL FIELD

The present invention relates in general to a method and associated apparatus for dispensing a small quantity of mercury or the like material from an evacuated and sealed glass capsule such as might be disposed in a fluorescent lamp. More particularly, the invention relates to a method and associated apparatus for employing an incandescent light source for heating and melting the capsule to thereby open the capsule and thus dispense the small quantity of mercury or the like material.

BACKGROUND ART

Methods have been devised for dispensing mercury or other materials with high vapor pressure characteristics in a gas-filled discharge tube such as a fluorescent lamp. Reference is now made to U.S. Pat. No. 3,684,345 which is directed to a method of dispensing mercury in connection with a gas-filled discharge tube, particularly a number indicator tube operating on the glow principle. Typically, the mercury or the like material is inserted into a capsule or ampule and the capsule is then inserted into the envelope of the tube. At the desired moment during the manufacturing process, mercury is released by destroying or deforming the ampule. In this regard, mention is made in U.S. Pat. No. 3,684,345 of a technique employing a heating coil for causing a softening and opening of the glass capsule. The inventive concepts described in the aforementioned patent relate to the use of the energy of a high intensity infrared radiation source. In this regard, the mercury containing ampule is fabricated from infrared absorbing glass, such as, for example, Corning glass No. 9362 having an outer diameter of 0.15" and an inner diameter of 0.10". This glass is highly absorbing to radiation in the region of one micron and when mounted inside glass tubing typically used for fluorescent lamp jackets, i.e. non-infrared absorbing material, the ampule can be heated to its softening point without any damage to the fluorescent glass tubing.

Thus, an incandescent light source may be utilized to open glass capsules containing mercury and disposed within processed fluorescent lamps. However, depending upon the volume of the capsule and the mass of the mercury, it has been found that for a relatively small ratio of the mass of mercury to the inner capsule volume, problems come about in being able to properly and accurately break (burst) and open the capsule.

DISCLOSURE OF THE INVENTION

It is, therefore, an object of the invention to obviate the disadvantages of the prior art.

It is an object of the present invention to provide an improved method and associated apparatus for dispensing small quantities of mercury or the like material from evacuated and sealed glass capsules. The method and apparatus of the present invention is particularly adapted for the dispensing of mercury in relatively low mass (mercury) to volume (capsule) ratio capsules.

Another object of the present invention is to provide a method and associated apparatus for dispensing small quantities of mercury from a sealed capsule employing an improved form of incandescent light source.

Still another object of the present invention is to provide a method and associated apparatus for dispensing small quantities of mercury from a sealed glass capsule and in which the opening of the capsule is carried out accurately and consistently.

These objects are acomplished, in one aspect of the invention, by the provision of a method of opening an evacuated and sealed capsule containing a material to be dispensed, said material having a relatively high vapor pressure, and the capsule being disposed in an evacuated envelope which comprises radiating the capsule from a first light source imaged along the capsule and substantially simultaneously radiating the capsule from a second light source imaging substantially transversely to the imaging of the first light source. A segment of the capsule is constrained by constraining means about the capsule which restricts formation of a bubble therein during the radiation.

The system comprises a first light source imaged along the capsule and a second light source imgaged substantially transversely to the imaging of the first light source and across the capsule. The capsule is provided with constraining means.

BRIEF DESCRIPTION OF THE DRAWINGS

FIG. 2 is a schematic plan view of one technique for opening capsules containing mercury employing an incandescent lamp source;

FIG. 3 is a side elevation view illustrating the manner in which the incandescent source interacts with the capsule to form an expanding bubble in a high mass to volume capsule;

BEST MODE FOR CARRYING OUT THE INVENTION

For a better understanding of the present invention together with other and further objects, advantages and capabilities thereof, reference is made to the following disclosure and appended claims in connection with the above described drawings.

There is now described in association with the drawings, a method and associated system for using an incandescent light source to dispense small quantities of material, such as mercury, from evacuated and sealed glass capsules. These evacuated and sealed glass capsules, when containing mercury, can be supported in a fluorescent lamp and may have an internal volume in the range of 0.01 or 0.10 cubic centimeters containing small amounts of mercury in the range of 0.1 mg to 10 mg. The method described herein is also applicable for the dispensing of other materials, particularly those having high vapor pressures.

It has been found that using the technique described in U.S. Pat. No. 3,684,345 is satisfactory for relatively large mass volume ratio capsules. However, problems arise as the ratio of the mass of mercury to inner capsule volume gets smaller.

Figure 1:
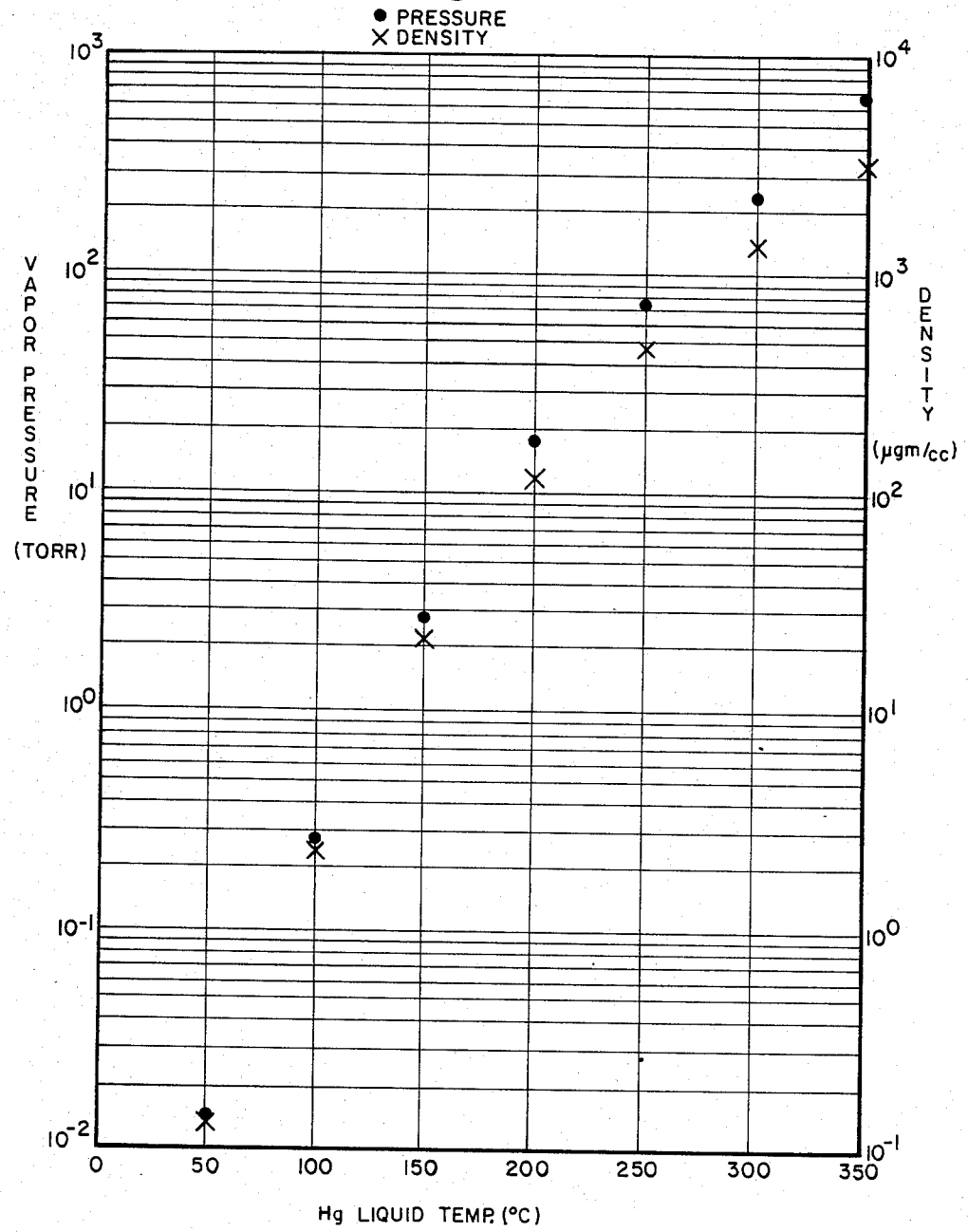
FIG. 1 is a plot of mercury vapor pressure and mercury vapor density within an enclosed volume above the mercury liquid as a function of mercury liquid temperature.

In analyzing the matter, reference is now made to FIG. 1 which is a plot of mercury vapor pressure and mercury vapor density on separate axes within an enclosed volume above the mercury liquid as a function of mercury liquid temperature. Values of the mass of mercury that have been dispensed range between 0.1 mg and 10 mg. The capsule volumes may range between 0.01 and 0.10 cubic centimeters. One relatively low mercury mass to capsule volume ratio that has been used is 0.1 mg of mercury to 0.1 cubic centimeters of capsule volume. With regard to FIG. 1, this corresponds to a maximum vapor density of $10^3$ micrograms/$cm^3$. As related in FIG. 1, this is associated with a vapor pressure of $10^2$ Torr assuming that all of the mass is in vapor form.

In one example, four mg of mercury is dispensed in a volume of 0.01 $cm^3$. This corresponds to a density of $4\times10^5$ mg/$cm^3$ corresponding to a pressure of $10^4$–$10^5$ Torr, again assuming all the mercury has been vaporized. Thus the relative difficulty in opening the low mass to volume ratio capsule is due, in part, to the reduced internal pressure achievable when all the mercury is vaporized. In this regard reference is made to FIG. 2 which shows one arrangement for opening capsules of mercury employing an incandescent projection lamp 10 which is comprised of an incandescent lamp envelope 12, a filament 14 and a mirror reflector 16. The projection lamp 10 may be a 150 watt lamp employing a parabolic reflector 16 such as Sylvania type DCA. The projection lamp is utilized to vaporize a portion of the mercury liquid contained in the capsule 20. The radiation from the projection lamp 10 at the same time raises the temperature of the glass of the capsule envelope to a sufficiently high temperature so that the glass becomes soft.

FIG. 2 shows the capsule 20 contained within a fluorescent lamp jacket 22 which typically includes a filament 24 suitably supported in a conventional manner in the fluorescent lamp tube. FIG. 2 also shows the capsule support wire 26 supported from the filament 24 at node 25. The manner of capsule support is discussed in further detail hereinafter.

Upon the capsule being subjected to heat from the projection lamp, an outwardly expanding bubble forms shown in dotted lines at 20A in FIG. 2. At the time that the glass reaches its softening point, the internal pressure imposed by the heated mercury is larger than the surrounding pressure within the fluorescent lamp jacket envelope 22 and which surrounding pressure is at about 2.5 Torr, and thus the bubble breaks, enabling a dispensing of the mercury vapor into the fluorescent lamp jacket.

FIG. 3 shows further detail of the inter relationship between the projection lamp 10 and the capsule 20 which is to be opened. FIG. 3 illustrates the imaging rays 18 directed from the filament 14, reflected at the mirror reflector 16 and directed toward the capsule 20 just above the relatively solid base 25 thereof.

It has been noted that for some capsule configuration 5 such as illustrated in FIG. 3, unless the projection lamp filament image is near the interface between the hollow bulb 21 of the capsule and the solid base 25 thereof, the capsule swells but does not consistently open.

In FIG. 3 it is noted that within the bulb 21 there is provided the mercury droplet 23. FIG. 3 also clearly shows the rays 18 directed to the proper area at the interface between the base 25 and the bottom of the bulb portion 21. When heated on this interface or transition region, a rapidly expanding bubble forms and does break consistently. The illustration of FIG. 3 also presupposes a relatively high mass to volume ratio capsule. As such there is sufficient vapor pressure when the heat is properly concentrated as illustrated to provide proper opening.

Figure 4:
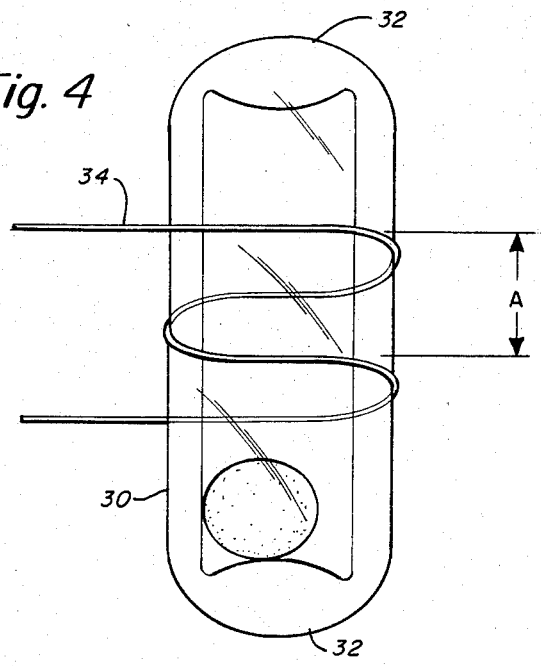
FIG. 4 shows a capsule for containing mercury and the associated constraining means useful in constraining the capsule envelope to limit the flow of glass into the bubble that is to be formed.

Although the technique of FIGS. 2 and 3 operate satisfactorily with respect to a relatively high volume ratio capsule, for low-mass-to-volume ratio capsules such as illustrated in FIG. 4, the capsule has been found not to open effectively with the use of a single projection lamp. This is due, in part, to the lower internal pressure which is expected causing the bubble to form much more slowly. Additionally, when using a single projection lamp with a low-mass-to-volume ratio capsule, there are two other factors which make the opening of the capsule more difficult. First, the use of a single lamp heating a relatively small surface area of the capsule allows the mercury to condense on other surfaces which in turn tends to reduce the maximum internal pressure in the capsule. This is overcome by using a second projection lamp, still imaged along the length of the capsule. Second, when the capsule is heated, a bubble starts to form at the filament image but such a large amount of glass flows into the bubble from the adjacent area that the bubble wall thickness never becomes thin enough to allow the bubble to burst. This problem has been overcome by the use of constraining means 34 such as illustrated in FIG. 4 to limit the flow of glass into the bubble.

Thus, in FIG. 4 there is shown a capsule 30 which may be of the type formed in accordance with the teachings in copending application Ser. No. 568,022, filed concurrently herewith. The capsule 30 may have a length on the order of 1 cm with an outer diameter of 0.15" and an inner diameter of 0.10". The capsule may have solid tips 32 illustrated or alternatively may be of the type that has an even thickness throughout the entire capsule. FIG. 4 also illustrates the constraining means 34 as a support wire, shown extending in two loops enclosing the capsule. The support wire 34 is preferably a Niron wire. The support wire loops are separated by a gap A, an edge-to-edge gap in the range of 2.0–2.5 mm. This gap corresponds approximately to the filament image size so that with respect to the filament imaged across the capsule, the greatest amount of heat is concentrated in this gap A.

Figure 5:
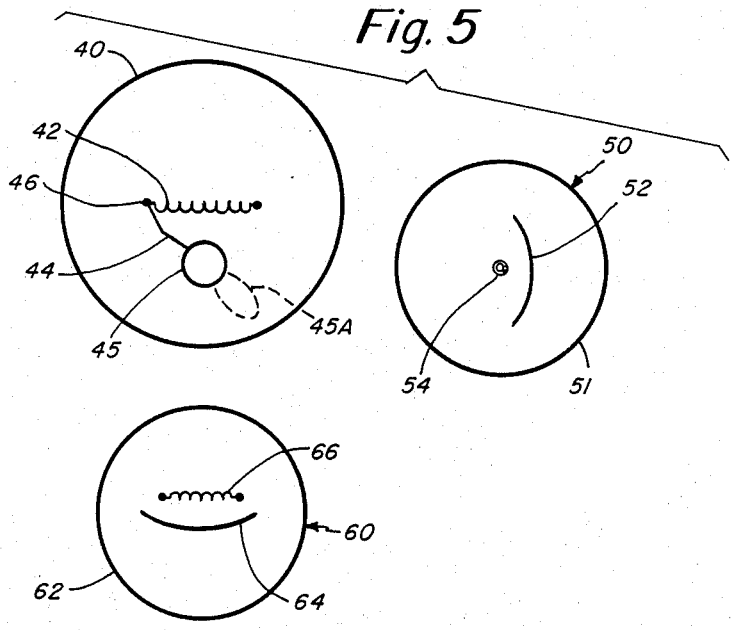
FIG. 5 schematically illustrates a plan view of a projection lamp arrangement employing two projection lamps, one with the filament imaged along the capsule and the other with the filament imaged across the capsule and used for opening low mass to volume ratio capsules.
Figure 6:
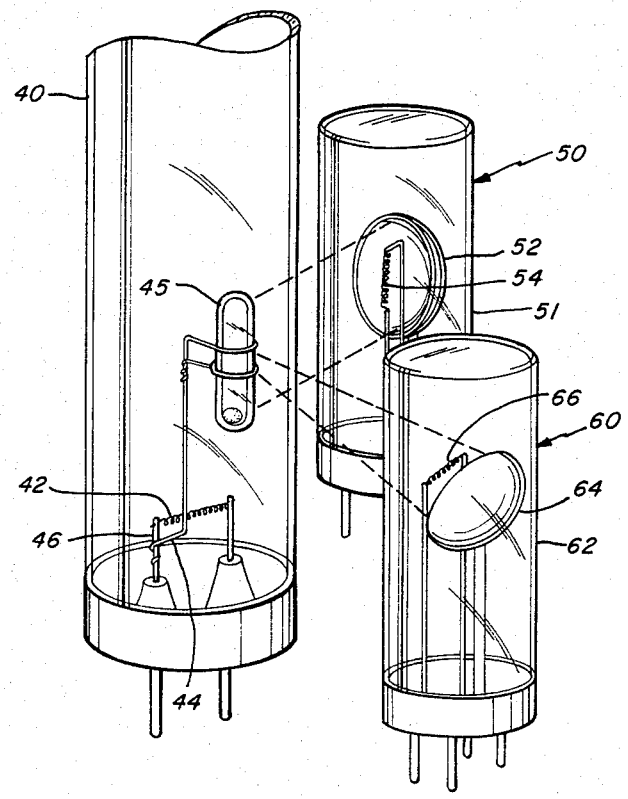
FIG. 6 is a perspective view of the projection lamp arrangement illustrated in FIG. 5.

Now, FIG. 5 shows the preferred configuration used for bursting or opening a low-mass-to-volume ratio capsule. Also, reference is made to FIG. 6 which is a perspective view illustrating the arrangement of two projection lamps for providing proper venting. In FIGS. 5 and 6, there is illustrated fluorescent lamp jacket envelope 40 having contained therein a lamp filament 42. A support wire 44 provides a means for supporting the capsule 45 within the envelope 40 and also forms a constraining means for limiting the flow of glass into the bubble to be formed. The support wire 44 is supported at node 46 from the filament 42. In connection with the capsule 45, it is noted that in FIG. 5 the capsule is shown with the bubble 45A being formed and indicated in dotted outline. In an alternate embodiment, the capsule 45 may be supported in an alternate manner within the envelope.

FIGS. 5 and 6 illustrate also a pair of projection lamps, including lamp 50 with its associated envelope 51. Within the envelope 51 is provided the reflector 52 and the filament 54. Similarly, there is a second projection lamp 60 having an envelope 62. Within the envelope 62 is the lamp reflector 64 and also the filament 66. With regard to the projection lamp 50, the filament 54 is imaged along the capsule 45. With projection lamp 60, the filament 66 is imaged across the capsule 45. The imaging of the projection lamp 60 is directed to the edge-to-edge gap A illustrated in FIG. 4. It is also noted that the bubble 45A is formed at essentially a 45° angle between the projection lamps 50 and 60. The projection lamps 50 and 60 are preferably disposed in relationship to the capsule 45 at about 90° to each other.

The two projection lamps 50 and 60 are operated to form a thin-walled bubble, which, after expanding about 10 mm bursts. Again, the direction which the bubble forms is shown in FIG. 5 essentially expanding between the two projection lamps 50 and 60.

It is also noted that the mercury contained in the capsule is essentially completely expelled when the capsule opens. This is in contrast to other opening techniques such as a laser dispensing technique in which a hole or crack may be formed in the capsule without necessarily expelling the contained mercury. Therefore, the technique of the present invention not only provides for reliable and consistent capsule opening but also provides sufficient opening to allow complete expelling of the mercury vapor when the capsule is opened.

While there have been shown and described what are at present considered the preferred embodiments of the invention, it will be obvious to those skilled in the art that various changes and modifications may be made therein without departing from the scope of the invention as defined by the appended claims.

We claim:

1. A method of opening an evacuated and sealed glass capsule containing a material to be dispensed having a relatively high vapor pressure, said capsule being disposed in an evacuated envelope, said method comprising the steps of: radiating the capsule from a first light source imaged along the capsule, substantially simultaneously radiating the capsule from a second light source imaging substantially transversely to the imaging of the first light source, and constraining a segment of the capsule by constraining means about the capsule which restricts formation of the bubble occurring from said radiating steps.

2. A method as set forth in claim 1 including positioning the light sources relative to the capsule so that the light sources are disposed 90° to each other.

3. A method as set forth in claim 1 wherein both radiating steps comprise radiating from an incandescent lamp.

4. A method as set forth in claim 1 wherein said step of constraining comprises wire loop constraining.

5. A method as set forth in claim 1 including securing the constraining means to the filament of the discharge tube.

6. A system for opening an evacuated and sealed glass capsule containing a material to be dispensed having a relatively high vapor pressure, said capsule being disposed in a discharge tube envelope, said system comprising a first light source imaged along the capsule, a second light source imaged substantially transversely to the imaging of the first light source and across the capsule, and means for constraining a segment of the capsule with the constraining means being effective over an area comparable to the imaging area of the second light source, constraining means being disposed about the capsule and restricting formation of any bubble being formed.

7. A system as set forth in claim 6 wherein the first and second light sources are positioned relative to the capsule so that the light sources are disposed 90° to each other.

8. A system as set forth in claim 7 wherein the bubble is formed between the first and second light sources.

9. A system as set forth in claim 6 wherein both said first and second light sources are incandescent lamps.

10. A system as set forth in claim 9 wherein said incandescent lamps are projection lamps.

11. A system as set forth in claim 6 wherein said means for constraining comprises wire loop means.

12. A system as set forth in claim 11 wherein said wire loop means comprises at least two loops of wire about the capsule having an edge-to-edge gap therebetween.

13. A system as set forth in claim 12 wherein said gap is on the order of 2.0–2.5 mm.

14. A system as set forth in claim 6 further including means for securing the constraining means to the filament of the discharge tube.

* * * * *